United States Patent [19]

Wimsatt et al.

[11] 4,015,589

[45] Apr. 5, 1977

[54] STEAM CLEANER PROTECTION SCREEN

[75] Inventors: James M. Wimsatt, Carson City; Carl Parise, Reno, both of Nev.

[73] Assignee: Parise & Sons, Inc., Reno, Nev.

[22] Filed: Jan. 20, 1976

[21] Appl. No.: 650,647

[52] U.S. Cl. ..... 126/344; 15/321; 15/353

[51] Int. Cl.[2] ..... A47L 5/00

[58] Field of Search ..... 15/320, 321, 353; 219/312; 222;146 HE/; 239/135; 126/344

[56] References Cited

UNITED STATES PATENTS

| | | | |
|---|---|---|---|
| 2,849,588 | 8/1958 | Marcuse | 219/312 |
| 3,239,649 | 3/1966 | Reeve | 219/310 |
| 3,431,582 | 3/1969 | Grave | 15/321 |
| 3,854,163 | 12/1974 | Evans | 15/321 |
| 3,896,521 | 7/1975 | Parise | 15/321 |

*Primary Examiner*—John J. Camby
*Assistant Examiner*—Larry I. Schwartz
*Attorney, Agent, or Firm*—Sughrue, Rothwell, Mion, Zinn & Macpeak

[57] ABSTRACT

This invention relates to steam cleaners for cleaning rugs, upholstery, and the like which comprise (a) a liquids pump, (b) a soap tank adapted to contain a mixture of water and detergent during use of the steam cleaner and having an outlet at the bottom thereof, and (c) means of fluid communication between the outlet at the bottom of the soap tank and the liquids pump. In this case, the invention comprises a screen in inverted-cup-form which is (d) readily pervious to the mixture of water and detergent contained in the soap tank during use of the steam cleaner, (e) impervious to foreign objects such as cigarette butts which may be introduced into the soap tank during use of the steam cleaner, and (f) releasably spring mounted inside the soap tank so as to surround the outlet in the bottom thereof and to filter substantially all of the mixture of water and detergent before it can enter the outlet during use of the steam cleaner, thereby preventing the foreign objects from passing through the means of fluid communication and into the liquids pump.

The invention also relates to steam cleaners for rugs, upholstery, and the like which comprise (a) a soap tank adapted to contain a mixture of water and detergent during use of the steam cleaner and (b) an open loop, single turn tubular electrical resistance heating element located in the soap tank for heating the mixture of water and detergent contained in the soap tank during use of the steam cleaner. In this case, the invention comprises a screen which is (c) readily pervious to the mixture of water and detergent contained in the soap tank during use of the steam cleaner, (d) impervious to the fingers of users of the steam cleaner, and (e) mounted inside the soap tank so as to surround the heating element, thereby preventing the fingers of users of the steam cleaner from touching the heating means during use of the steam cleaner.

In steam cleaners which comprise the soap tank, the liquids pump, the means of fluid communication, and the heating means, the screen preferably surrounds both the outlet from the soap tank and the heating means.

In any event, the screen is preferably releasably mounted in the soap tank so as to facilitate its cleaning and replacement.

2 Claims, 5 Drawing Figures

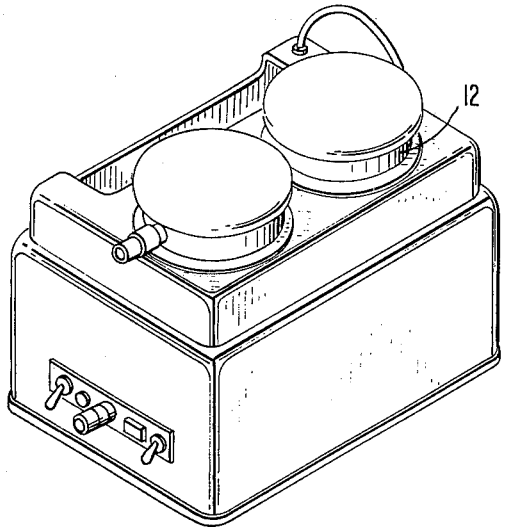
FIG. 1
FIG. 2
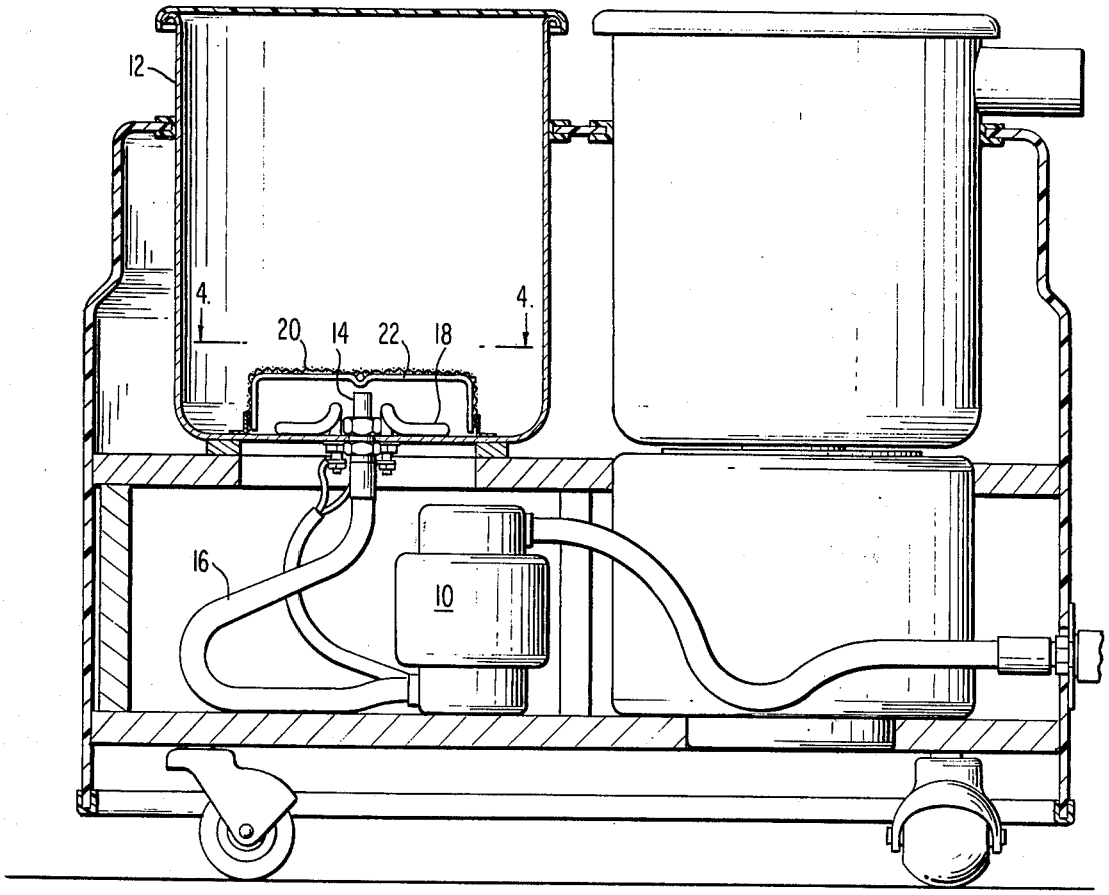

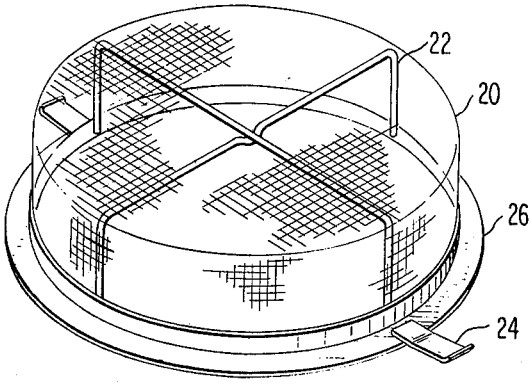
FIG. 3
FIG. 4
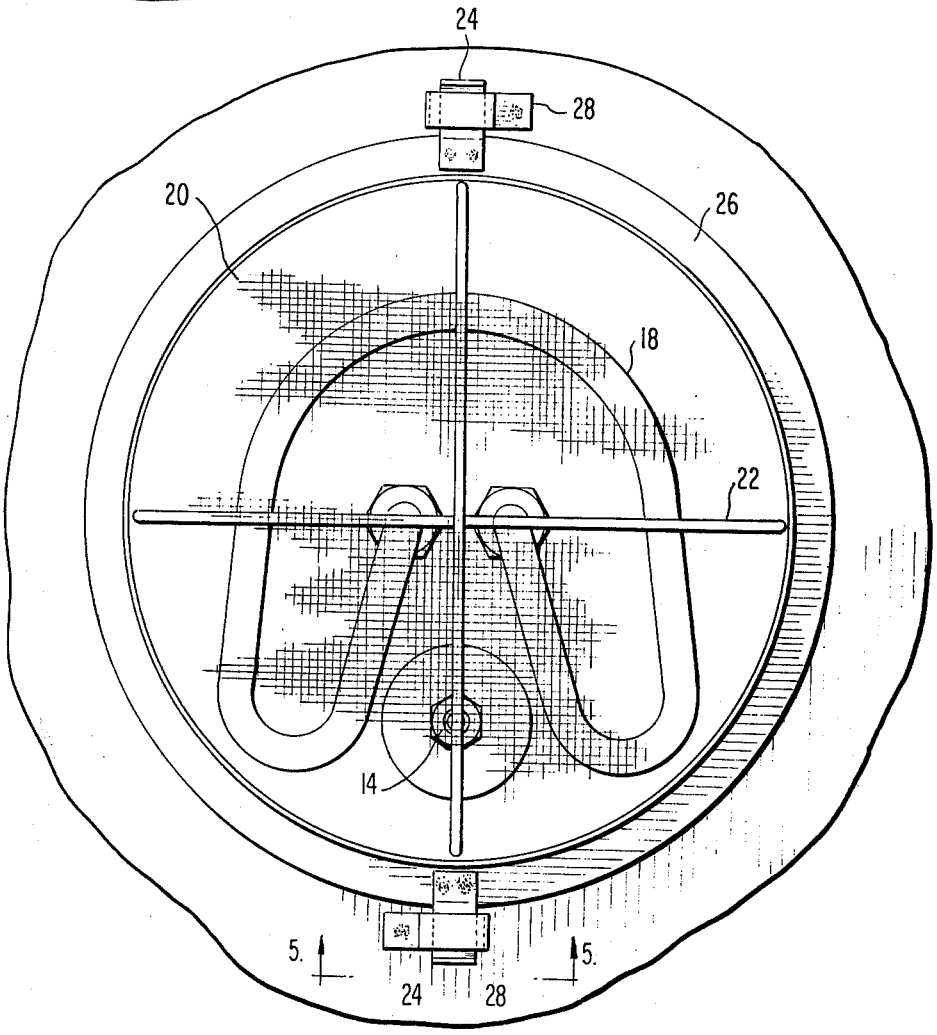
FIG. 5
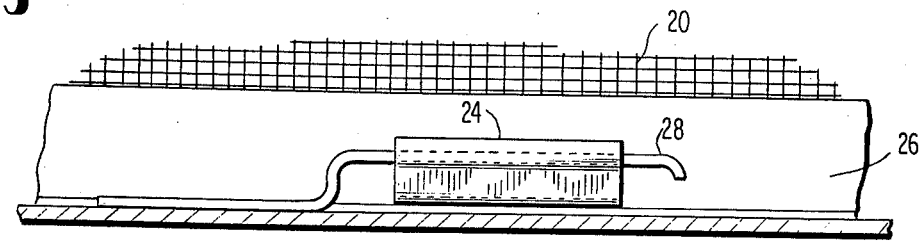

STEAM CLEANER PROTECTION SCREEN

FIELD OF THE INVENTION

This invention relates to steam cleaners for cleaning rugs, upholstry, and the like.

DESCRIPTION OF THE PRIOR ART

Steam cleaners for cleaning rugs, upholstry, and the like which comprise (a) a liquids pump, (b) a soap tank adapted to contain a mixture of water and detergent during use of the steam cleaner and having an outlet at the bottom thereof, and (c) means of fluid communication between the outlet at the bottom of the soap tank and the liquids pump are known and are described, for example, in commonly assigned U.S. Pat. Nos. 3,896,521 and 3,911,524. Some, but not all, of such steam cleaners also comprise means located in the soap tank for heating the mixture of water and detergent contained in the soap tank during use of the steam cleaner; commonly assigned U.S. Pat. No. 3,896,521 discloses such a steam cleaner.

It has been found that foreign objects such as cigarette butts are all too commonly introduced into the soap tanks of steam cleaners such as are disclosed in the above patents during use thereof, and, since such steam cleaners have no means for filtering the mixture of water and detergent as it passes from the soap tank to the liquids pump, the foreign objects often are carried into the liquids pump with the mixture of water and detergent, where they can damage or destroy the liquids pump.

It has also been found that users of steam cleaners such as are disclosed in the first of the above patents all too commonly touch the heating means either with their fingers or with heat-damagable parts of the steam cleaner during use of the steam cleaner or so shortly thereafter that the heating means has not had time to cool off.

OBJECTS OF THE INVENTION

The invention is designed to obviate either or both of the above-noted deficiencies of the prior art.

SUMMARY OF THE INVENTION

The invention in its narrowest aspect comprises a screen which is (a) readily pervious to the mixture of water and detergent contained in the soap tank during use of the steam cleaner, (b) impervious to foreign objects such as cigarette butts which may be introduced into the soap tank during use of the steam cleaner, (c) impervious to the fingers of users of the steam cleaners, and (d) releasably mounted inside the soap tray so as to surround the outlet from the soap tank and the heating means.

BRIEF DESCRIPTION OF THE DRAWINGS

FIG. 1 is a perspective view of a steam cleaner into which the subject invention may be incorporated.

FIG. 2 is a cross-sectional view of a steam cleaner into which the subject invention has been incorporated.

FIG. 3 is a perspective view of one embodiment of a screen which may be used in the subject invention.

FIG. 4 is a fragmentary top view of the bottom of the soap tank of a steam cleaner embodying the subject invention.

FIG. 5 is a view along the line 5—5 in FIG. 4.

DETAILED DESCRIPTION OF THE PRESENTLY PREFERRED EMBODIMENT

FIG. 1 shows a steam cleaner such as is disclosed in commonly assigned U.S. Pat. No. 3,896,521, and FIG. 2 shows such a steam cleaner with the exception of the addition of the hereinafter-described protection screen. Such steam cleaners comprise a liquids pump 10, a soap tank 12 of cylindrical form and having a bottom wall adapted to contain a mixture of water and detergent (the word "detergent" being used broadly herein to indicate any cleaning agent) during use of the steam cleaner and having an outlet 14 in the form of a tube which projects through at the bottom wall thereof, means of fluid communication 16 between the outlet 14 and the liquids pump 10, and heating means 18 located in the soap tank 12 for heating the mixture of water and detergent contained in the soap tank 12 during use of the steam cleaner. The heater means comprises a conventional tubular electrical resistance heater in the form of an open loop, single turn coil overlying the bottom of the soap tank, about outlet 14. The balance of such a steam cleaner, with the exception of the hereinafter-described protection screen, is described in commonly assigned U.S. Pat. No. 3,986,521, the text of which is hereby incorporated by reference, and it accordingly will not be further described herein.

FIG. 3 shows one embodiment of a screen 20 which may be used in the subject invention. The exact shape of the screen 20 is more-or-less arbitrary, and the indicated cylindrical shape should be understood as exemplary only. The screen 20 which is cup-shaped, FIG. 3, must, however, have a mesh which is readily pervious to the mixture of water and detergent contained in the soap tank 12 during use of the steam cleaner. If the screen 20 is to filter the mixture of water and detergent before it enters the outlet 14, it must, moreover, have a mesh which is impervious to foreign objects such as cigarette butts which may be introduced into the soap tank 12 during use of the steam cleaner, and it must be mounted inside the soap tank 12 so as to surround the outlet 14 and to filter substantially all of the mixture of water and detergent before it can enter the outlet 14 during use of the steam cleaner. On the other hand, if the screen 20 is to prevent the user of the steam cleaner from touching the heating means 18 during use of the steam cleaner, it must additionally have a mesh which is impervious to the fingers of users of the steam cleaner (which are, generally speaking, smaller than the heat-damagable parts of the steam cleaner with which users of the steam cleaner might also touch the heating means 18), and it must be mounted inside the soap tank 12 so as to surround the heating means 18. If the screen 20 is to perform both functions, it must, of course, be mounted inside the soap tank 12 so as to surround both the outlet 14 and the heating means 18.

To strengthen the screen 20 and to provide resistance against damage due to pressure against the screen 20 by parts of the steam cleaner stored in the soap tank 12 when the steam cleaner is not in use, structural reinforcing means such as the heavy wires 22 are preferably provided.

Although not absolutely essential to the functioning of the screen 20, it is preferably releasably mounted to the bottom of the soap tank 12 by means such as upwardly biased spring tabs 24 integrally connected to the screen 20 via a rim 26 and clips 28 mounted on the bottom of the soap tank 12. The fact that the screen 20 is releasably mounted inside the soap tank 12 facilitates its removal for cleaning or replacement.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

We claim:

1. In a steam cleaner for cleaning rugs, upholstry, and the like, said steam cleaner comprising: a soap tank adapted to contain a mixture of water and detergent during use of the steam cleaner, said tank including a bottom wall and a tubular electrical resistance heater element in the form of an open loop, single turn coil overlying the bottom wall of the soap tank for heating the mixture of water and detergent contained in the soap tank during use of the steam cleaner, and a tank outlet tube projecting through the bottom wall of the tank within the confines of said heater element, the improvement comprising an inverted cup-shaped screen, facing said bottom wall and overlying said heater element and outlet tube, an annular rim surrounding the periphery of the screen adjacent its open end, spring tabs fixed to said rim at circumferentially spaced positions and extending radially therefrom, spring clips fixed to the bottom wall of said soap tank at positions corresponding to said spring tabs on said screen on opposite sides of said resistance heater element with portions overlying the radially projecting ends of said tabs of said inverted cup-shaped cylindrical screen such that, said screen is pervious to the mixture of water and detergent contained in the soap tank during the use of the steam cleaner, and impervious to the fingers of users of the steam cleaner and of implements which may be inserted within said tank and acts simultaneously to filter foreign objects such as cigarette butts which may be introduced into the soap tank during use of the steam cleaner and wherein, said cup-shaped screen may be readily removed by rotating said screen to detach said tabs from said spring clips.

2. The steam cleaner as claimed in claim 1, further comprising a pair of inverted U-shaped wires fixed to said screen at said annular rim and crossing at right angles to each other within said screen to reinforce said screen and prevent crushing of said screen in a direction toward said heater element and said outlet tube.

* * * * *